United States Patent [19]

Mann

[11] Patent Number: 5,000,209

[45] Date of Patent: Mar. 19, 1991

[54] JEWELRY CLEANING SYSTEM

[75] Inventor: Samuel J. Mann, Englewood, N.J.

[73] Assignee: Inverness Corporation, Fair Lawn, N.J.

[21] Appl. No.: 433,926

[22] Filed: Nov. 9, 1989

[51] Int. Cl.[5] ..... B08B 3/04

[52] U.S. Cl. ..... 134/135; 134/182; 134/201; 206/6.1; 206/207; 220/94 R

[58] Field of Search ..... 134/117, 135, 143, 182, 134/183, 184, 201; 68/197; 220/94 R; 206/6.1, 205, 207, 208, 209, 209.1, 804; 99/407, 415; 126/369

[56] References Cited

U.S. PATENT DOCUMENTS

| | | | |
|---|---|---|---|
| 1,201,207 | 10/1916 | Leyden | 206/209.1 |
| 2,011,869 | 8/1935 | Pecker | 126/369 X |
| 2,040,004 | 5/1936 | Kelsay | 126/369 X |
| 2,664,854 | 1/1954 | Talbot | 134/135 X |
| 3,121,438 | 2/1964 | Kennedy | 134/135 |
| 3,292,776 | 12/1966 | Penn | 206/804 X |
| 3,572,870 | 3/1971 | Marks et al. | 220/94 R X |

*Primary Examiner*—Philip R. Coe
*Attorney, Agent, or Firm*—Blum Kaplan

[57] ABSTRACT

A jewelry cleaning system for facilitating the placement and removal of jewelry before, during and after cleaning is provided. The jewelry cleaning system comprises a container including a bottom wall and a side wall. The uppermost edge of the side wall defines an opening. A cover interacts with the side wall and is releasably securable to the side wall in order to define a closed container. A basket is capable of being positioned within the container. A displaceable handle is mounted to the basket so that when the basket is positioned in the container and the cover is secured to the side wall, both the basket and handle are retained in the closed container, and when the basket is positioned in the container and cover is removed from the container, the handle is displaced and projects above the uppermost edge of the side wall.

16 Claims, 2 Drawing Sheets

FIG. 1
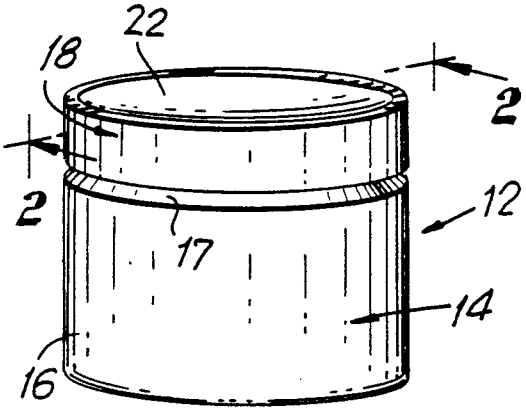
FIG. 2
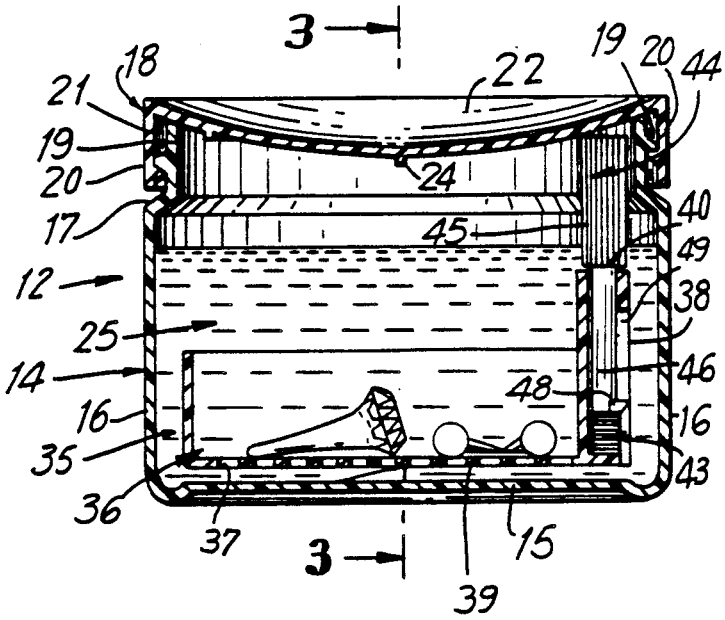
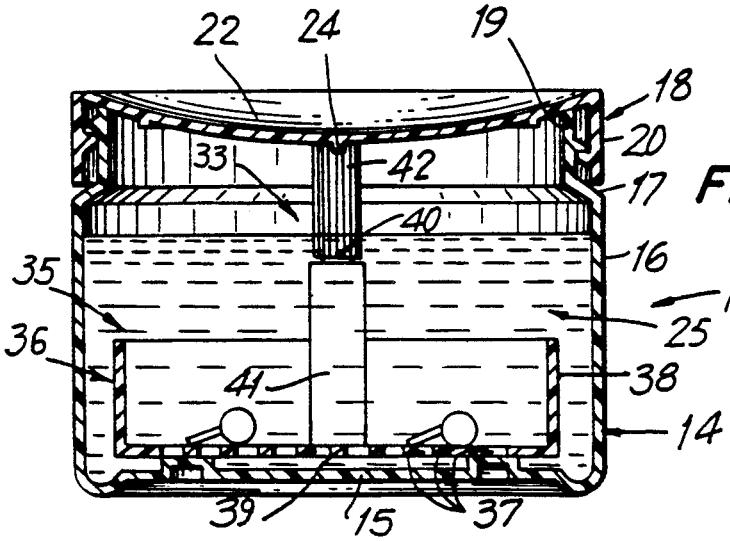
FIG. 3

FIG. 4
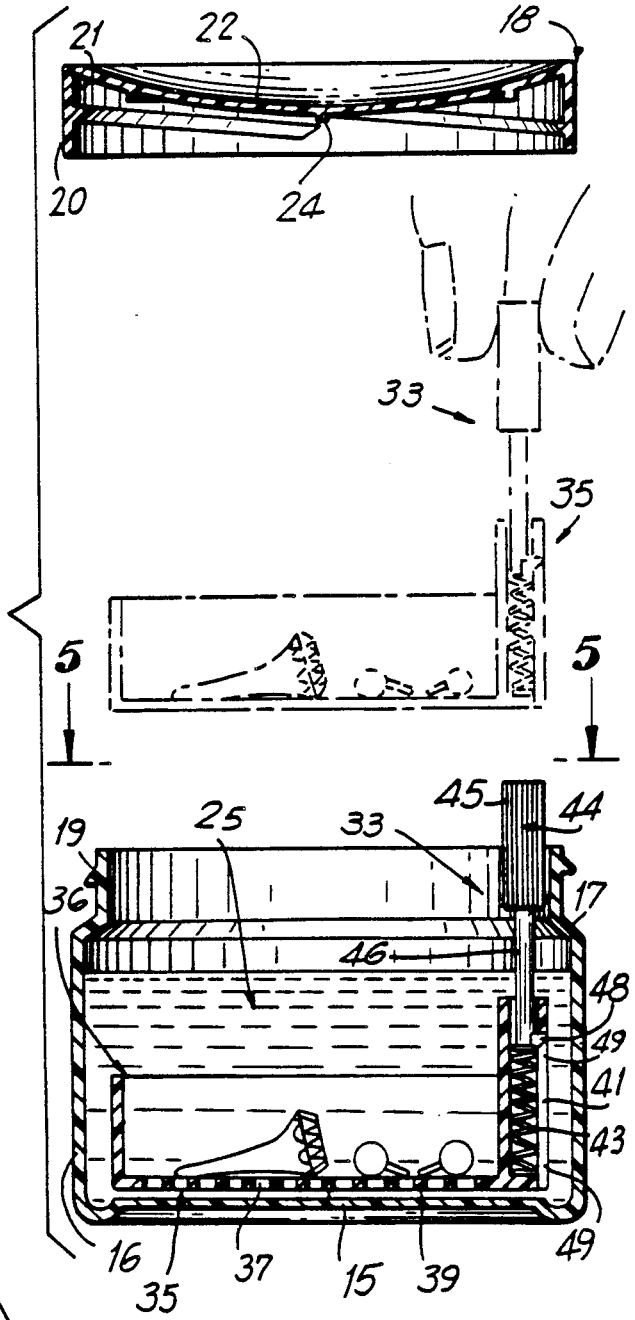
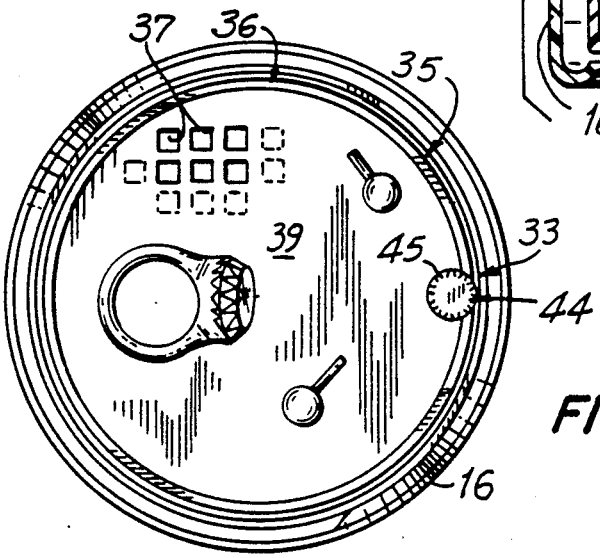
FIG. 5

JEWELRY CLEANING SYSTEM

BACKGROUND OF THE INVENTION

The invention is directed to a jewelry cleaning system and, in particular, to an improved basket and container assembly for facilitating the placement and removal of the jewelry from the cleaning solution before, during and after cleaning.

Heretofore, the most popular known jewelry cleaning system has been a covered jar containing a cleaning solution and basket assembly. The basket sits in a jar filled with a colored ammonia based fluid. The jewelry is placed in a basket and the basket is positioned in the jar so that the jewelry is permitted to soak in the ammonia fluid until it is clean. The basket is usually provided with an upright post which serves as a handle and facilitates lifting the basket from the container in order to remove and replace jewelry.

These products have been found to be less than completely satisfactory. The particular disadvantage of such jar type jewelry cleaning systems is that the basket handle cannot be removed by a woman without wetting her fingernails and causing damage to her nail polish finish. The colored ammonia fluid can also stain clothing and towels. A second disadvantage is that the jar and basket cleaners have an inclination to leak. This is due to the surface tension of the ammonia fluid which causes it to adhere to the cover. When the cover is removed from the jar, the ammonia follows gravity and flows onto the user's hands. Accordingly, a jar and basket jewelry cleaning assembly that minimizes contact with the jewelry cleaning fluid is desired.

SUMMARY OF THE INVENTION

Generally speaking in accordance with the instant invention, a jar and basket jewelry cleaning system for facilitating the placement and removal of jewelry before, during and after cleaning is provided A container including a widemouthed jar having a removable cover is provided. The basket includes a displaceable handle that is displaceable at at least a first position extending above the opening of the jar when the cover is removed from the jar. When the cover is secured to the jar, the handle is displaced into in a second position that permits the cover to be secured to the jar to provide a sealed container.

Accordingly, it is an object of the invention to provide an improved jar and basket jewelry cleaning system.

Another object of the instant invention is to provide reduced leakage of ammonia fluid from a jar and basket jewelry cleaning system when the cover is removed from the jar.

Still another object of the instant invention is to provide a jar and basket jewelry cleaning assembly that is configured to permit large pieces of jewelry to be cleaned.

A further object of the instant invention is to provide a jar and basket jewelry cleaning system that prevents cleaning solution from leaking when the cover is removed during use.

A further object of the invention to provide an improved jar and basket jewelry cleaning system that minimizes the opportunity for cleaning fluid to come into contact with a woman's fingernails during use.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a perspective view of a jar and basket jewelry cleaning system constructed in accordance with a preferred embodiment of the instant invention:

FIG. 2 is a sectional view taken along line 2—2 of FIG. 1.

FIG. 3 is a sectional view taken along line 3—3 of FIG. 2.

FIG. 4 is an exploded view of the jar and basket jewelry cleaning system of the instant invention and the manner in which the basket is removed from the jar; and FIG. 5 is a sectional view taken along line 5—5 of FIG. 4.

DETAILED DESCRIPTION OF THE PREFERRED EMBODIMENTS

Reference is first made to FIGS. 1 through 3, wherein a jar and basket jewelry cleaning system, generally indicated at 12, is depicted. System 12 includes a jar 14 and a cover 18. Jar 14 includes a bottom wall 15 and a continuous cylindrical side wall 15. Cylindrical side wall 16 extends from bottom wall 15 and includes an inwardly inclined shoulder 17 and a threaded neck 19 which defines the rim forming the opening in jar 14. In an exemplary embodiment, the diameter of jar 14 is greater than the height of the side wall in order to facilitate the cleaning of large pieces of jewelry.

Cover 18 includes a top wall 22 and a side wall 20 having threads 21 extending therethrough for permitting cover 18 to be releasably secured to the threaded neck 19 of the jar. In an exemplary embodiment, top wall 22 of cover 18 is concave (when viewed from the outside) and includes a tip 24 positioned on the interior of top wall 19 at the center of the concave wall so that it is projecting in the direction of the floor 15 of jar 14. The concave shape of the cover causes cleaning fluid 25 to follow gravity and drain off the tip 24. By positioning tip 24 at the apex of the concavity of top wall 19, a locus is formed that causes the fluid 25 to drip back into the container 12.

Positioned within jar 14 is a basket assembly 35 for retaining the jewelry during the cleaning process. Basket assembly 35 includes a basket 36 and a handle assembly 40. Basket assembly 35 includes floor 39 having apertures 37 therein and an upright side wall 38. Openings 37 permit the cleaning solution 25 to drain out of the basket when the basket is removed from jar 14.

Displaceable handle assembly 4 is integrally formed with basket assembly 35. Handle assembly 40 is positioned at the outer rim of the basket 36 to allow for the maximum unobstructed, usable basket area. Displaceable handle mechanism 33 includes a sleeve 41 which is integral with side wall 38 and extends above side wall 38. A stainless steel coil spring 43 is disposed in sleeve 41. A handle 44 includes an enlarged knurled head 45 and an elongated arm 46. Elongated arm 46 is provided with an outside diameter that is slightly smaller than the inside diameter of sleeve 41 so that arm 46 can be slideably displaced in sleeve 40. The knurled crosssection of head 44 helps to minimize the collection of cleaning solution on the handle assembly. A vane 48 projects laterally from arm 46 at the tip thereof and is positioned in elongated slot 49 disposed along part of the length of sleeve 41.

Referring now to FIG. 4, the displacement of the handle mechanism 33 from a displaced position when the cover is secured to the jar (FIGS. 2 and 3) to an extended position (FIG. 4) when the cover is removed from the jar, is depicted. Specifically, when the user removes the cover 18 from jar 18, spring 43 displaces the handle 44 out of sleeve 41 so that the handle projects beyond wall 14 which forms the opening of the jar. The user can then grasp the handle 44 without touching the cleaning fluid 20.

Accordingly, the instant invention is particularly characterized by an improved jewelry cleaning container which uses a spring loaded handle to facilitate the removal of the basket in order to prevent the cleaning fluid from touching the user's hands. The concave shaped cover and tip at the apex of the concavity also aid in preventing the spillage of cleaning fluid by forcing the fluid to flow back into the container rather than on the user's hands. Also, by positioning the handle at the perimeter of the basket, by configuring the jar to have a diameter that is longer than the height of the jar, larger size pieces of jewelry can be cleaned with facility.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A jewelry cleaning system comprising:

a container means comprising a bottom wall and at least one side wall, said side wall defining an uppermost rim and a cleaning solution disposed within said container means;

a cover means for the container means which interacts with the side wall to permit the cover means to be releasably secured to the side wall to permit the cover means to be releasably secured to the side wall in order to define a closed container;

a basket adapted to retain jewelry therein which is capable of being displaceably positioned within the container means; and a displaceable handle mounted to the basket and not affixed to the cover means so that when the basket is positioned in the container means and the cover means is secured to the side wall, both the basket and handle are retained in the closed container, and when the basket is positioned in the container mean and as the cover means is being removed from the container means, the handle is displaceably biased to a position that projects above the rim of the side wall.

2. The jewelry cleaning system of claim 1, wherein the handle is positioned substantially tangential to the basket.

3. The jewelry cleaning system of claim 1, wherein the container means is a wide-mouth jar.

4. The jewelry cleaning system of claim 1, wherein the basket has at least one upright side wall and a bottom containing apertures.

5. A jewelry cleaning system comprising:

a container means comprising a bottom wall and at least one side wall, said side wall defining an uppermost rim and a cleaning solution contained therein;

a cover means for the container means which interacts with the side wall to permit the cover means to be releasably secured to the side wall in order to define a closed container;

a basket adapted to receive jewelry therein which is capable of being displaceably positioned in the container means; and a displaceable handle mounted to the basket so that when the basket is positioned in the container means and the cover means is secured to the side wall, both the basket and handle are retained in the closed container, and when the basket is positioned in the container means and the cover means is removed from the container means, the handle is displaceably biased to a position that projects above the rim of the side wall, and wherein the handle has a sleeve containing a stainless steel coil spring which compresses when the basket is positioned in the container means and the cover means is secured to the side wall, and which releases when the cover means is removed from the container means to thereby bias said handle so that the handle projects above the uppermost rim of the jar.

6. The jewelry cleaning system of claim 5, wherein the handle has an elongated arm and an enlarged head, and wherein the outside diameter of the elongated arm is smaller than the inside diameter of the sleeve such that the elongated arm can be slideably displaced in the sleeve.

7. The jewelry cleaning system of claim 6, wherein the enlarged head is knurled.

8. The jewelry cleaning system of claim 7, wherein a vane projects laterally from the tip of the elongated arm and is positioned in an elongated slot disposed along part of the length of the sleeve.

9. A jewelry cleaning system comprising:

a container means comprising a bottom wall and at least one side wall, said side wall defining an uppermost rim and a cleaning solution disposed in the container means;

a cover means for the container means which interacts with the side wall to permit the cover means to be releasably secured to the side wall in order to define a closed container;

a basket adapted to receive jewelry therein which is capable of being removably displaceably positioned within the container means; and a displaceable handle displaceably mounted to the basket so that when the basket is positioned in the container means and the cover means is secured to the side wall, both the basket and handle are retained in the closed container and are not affixed to the cover means, and when the basket is positioned in the container means and as the cover means is removed from the container means, the handle is displaced above the rim of the side wall.

10. The jewelry cleaning system of claim 9 wherein the handle is positioned substantially tangential to the basket.

11. The jewelry cleaning system of claim 9, wherein the container means is a wide-mouth jar.

12. The jewelry cleaning system of claim 9, wherein the basket has at least one upright side wall and a bottom containing apertures.

13. A jewelry cleaning system comprising:

a container means comprising a bottom wall and cylindrical side wall, said cylindrical side wall defining an uppermost rim and having an inwardly inclined shoulder and a threaded neck and cleaning solution disposed in said container means;

a cover means for the container means which interacts with the cylindrical side wall to permit the cover means to be releasably secured to the cylindrical side wall in order to define a closed container;

a basket adapted to receive jewelry therein which is capable of being displaceably positioned within the container means; and a displaceable handle mounted to the basket so that when the basket is positioned in the container means and the cover means is secured to the cylindrical side wall, both the basket and handle are retained in the closed container and the handle is not affixed to the cover means, and when the basket is positioned in the container means and as the cover means is removed from the container means, the handle is displaceably biased to a position that projects above the rim of the cylindrical side wall.

14. A jewelry cleaning system comprising:

a container means comprising a bottom wall and at least one side wall, said side wall defining an uppermost rim, wherein the diameter of the bottom wall is greater than the height of the side wall and a cleaning solution within said container means;

a cover means for the container means which interacts with the side wall to permit the cover means to be releasably secured to the side wall in order to define a closed container;

a basket adapted to received jewelry therein which is capable of being displaceably positioned within the container means; and a displaceable handle mounted to the basket so that when the basket is positioned in the container means and the cover means is secured to the side wall, both the basket and handle are retained in the closed container and are not affixed to the cover means, and when the basket is positioned in the container means and as the cover means is removed from the container means, the handle is displaceably biased to a position that projects above the rim of the side wall.

15. A jewelry cleaning system comprising:

a container means comprising a bottom wall and at least one side wall, said side wall defining an uppermost rim and a cleaning solution in said container;

a cover means for the container means which interacts with the side wall to permit the cover means to be releasably secured to the side wall in order to define a closed container, wherein the top wall of the cover means is concave such that the center of the top wall is lower than the rim of the top wall;

a basked adapted to receive jewelry therein which is capable of being displaceably positioned within the container means; and a displaceable handle mounted to the basket so that when the basket is positioned in the container means and the cover means is secured to the side wall, both the basket and handle are retained in the closed container and are not affixed to the cover means, and when the basket is positioned in the container means and as the cover means is removed from the container means, the handle is displaceably biased to a position that projects above the rim of the side wall.

16. The jewelry cleaning system of claim 15, wherein the top wall of the cover means has a tip positioned at the center of the interior of the concave top wall which projects downward when the cover means is secured to the side wall.

* * * * *